US005186620A

United States Patent [19]

Hollingshead

[11] Patent Number: 5,186,620

[45] Date of Patent: Feb. 16, 1993

[54] GAS BURNER NOZZLE

[75] Inventor: Wayne S. Hollingshead, Guelph, Canada

[73] Assignee: Beckett Gas, Inc., North Ridgeville, Ohio

[21] Appl. No.: 679,636

[22] Filed: Apr. 1, 1991

[51] Int. Cl.[5] ..... F23D 14/46; F23D 14/62; F23Q 9/00

[52] U.S. Cl. ..... 431/354; 431/286; 431/114; 431/346; 239/558

[58] Field of Search ..... 431/345, 346, 350, 349, 431/354, 191, 193, 114, 286; 239/548, 552, 561, 558, 553.5, 553, 553.3

[56] References Cited

U.S. PATENT DOCUMENTS

| | | | |
|---|---|---|---|
| Re. 19,959 | 8/1933 | Coleman . | |
| 686,625 | 11/1901 | Machlet | 431/349 X |
| 790,714 | 5/1905 | Bray | 239/558 X |
| 1,005,930 | 10/1911 | Borderel | 239/558 |
| 1,239,681 | 9/1917 | English . | |
| 1,394,721 | 10/1921 | Festa . | |
| 1,424,739 | 8/1922 | Reeves | 431/286 X |
| 1,809,658 | 2/1929 | Wendt . | |
| 1,908,135 | 5/1930 | Forster . | |
| 1,973,371 | 9/1934 | Charles et al. | 239/558 X |
| 2,187,674 | 1/1940 | Anderson et al. | 239/553.5 |
| 2,655,206 | 7/1949 | Eichelman . | |
| 3,092,169 | 6/1963 | Lohman | 431/191 |
| 3,198,238 | 8/1965 | Hughes | 431/286 X |
| 3,685,949 | 8/1972 | Greaves . | |
| 4,067,686 | 1/1978 | Karpisek . | |
| 4,269,358 | 5/1981 | Ohtani et al. . | |
| 4,434,976 | 3/1984 | Murakami et al. | 239/553 X |

*Primary Examiner*—Carl D. Price
*Attorney, Agent, or Firm*—Watts, Hoffmann, Fisher & Heinke Co.

[57] ABSTRACT

An inshot gas burner nozzle having a flame retention insert that enhances flame stability and reduces noise, the insert comprising a central opening, secondary openings of smaller diameter arranged circularly around the central insert, and a plurality of restricted peripheral openings in the form of stepped notches. The nozzle further comprises plenum chambers which have restricted outlets thereby creating back pressure within the plenums to improve cross-ignition of adjacent nozzles.

9 Claims, 6 Drawing Sheets

GAS BURNER NOZZLE

TECHNICAL FIELD

This invention relates to gas burner nozzles, and more specifically to inshot gas burner nozzles.

BACKGROUND

Inshot gas burner nozzles, such as used in furnaces and many appliances, generally comprise a venturi tube which diverges from its input end to an enlarged output end. In some constructions, a burner head insert made of sintered or powdered metal having outlet openings is mounted in the outlet end of the tube. In operation, gas is injected into the inlet end of the nozzle, entraining air into the nozzle with it. This primary air/gas mix flows through the tube to the burner head or flame retention insert. The primary air/gas mix passes through the insert and burns as it exits the insert forming a cone of flame projecting from the outer face. Secondary air flows around the outside of the venturi tube and is entrained in the burning mixture around the outside of the insert in order to complete combustion.

Some of the problems associated with conventional inshot burner designs are flame stability and noise. The velocity of the primary air/gas flow from the insert is often greater than the flame speed. Under this condition, the flame lifts off from the burner insert, i.e. the flame begins to burn in mid air at a location spaced from the outer face of the flame retention insert. Flame liftoff is a major cause of the noise associated with the operation of inshot burner nozzles.

If the velocity of the air/gas mixture is too slow when compared to the flame speed, flashback can occur. Flashback is the burning of the gas within the burner nozzle itself. This condition can cause overheating and deterioration of the nozzle.

Various flame retention or burner head inserts have been designed in the past in an attempt to achieve better flame stability and reduction of noise. One known insert has a central opening surrounded by a toothed perimeter or sunburst. The air/gas mixture passing through the central opening of the insert forms an inner flame cone, while the air/gas mixture passing through the sunburst forms a mantle around the flame cone. The velocities of air/gas flow through the sunburst and the central opening are nearly the same. Another known insert has a central opening surrounded by a series of smaller holes. Again, the velocities of air/gas flow through the smaller holes and the central opening are nearly the same. Flame instability, particularly liftoff with its attendant noise, are associated with both of these prior art insert designs.

In most appliances, the inshot nozzles are arranged side-by-side and provision is made for cross ignition. One conventional nozzle has two diametrically opposed, narrow plenum chambers that extend radially from the outlet end of the venturi tube. Each plenum chamber has an outlet along its front or leading edge and along its side edges. Gas escaping from the side edges of the plenums of one nozzle burns and thereby ignites the gas escaping the plenums of the adjacent nozzles. With this conventional construction, it has been difficult to achieve uniform and consistent cross ignition, particularly at low gas input rates.

SUMMARY OF THE INVENTION

An object of the present invention is to provide an improved inshot gas burner nozzle which is characterized by good flame stability and low operational noise.

A more particular object of the invention is to provide a new flame retention insert for an inshot gas burner nozzle which makes it possible to control the velocity of gas flow through the insert in a manner which reduces the occurrence of flame liftoff and resulting noise.

Another object of the present invention is to provide an improved gas burner nozzle which has consistent cross-ignition characteristics over varied gas input rates, and more particularly one that will consistently cross-ignite at low input rates.

Another object of the invention is to provide an inshot gas burner nozzle which burns a high ratio of primary air to gas without flashback.

The inshot burner nozzle of the present invention generally comprises a venturi tube having an inlet end where the gas and primary air are introduced. The venturi tube diverges to an enlarged outlet end in which a flame retention insert is mounted. The objectives of flame stability and reduction of flame liftoff with resulting noise is achieved through a new insert configuration. In the preferred embodiment, the insert outlet openings are arranged in three concentric zones. The inner zone is formed by a primary outlet opening located at the center of the insert. A plurality of secondary openings are circularly arranged around the center opening to form the second zone. The third zone of openings is formed by notches in the perimeter of the insert. The notches have stepped depths. The shallower depths form throats or restricted flow passages that open on the inner face of the insert. The deeper depths define expansion regions that open on the outer face of the insert.

The described construction of the preferred embodiment controls the velocities of the gases exiting through the various openings in a manner that provides for improved flame stability. In operation, a large inner flame cone is formed by burning the primary mix of air and gas passing through the central opening of the 1 insert. The primary mix of air and gas flowing through the surrounding openings in the second zone forms a suggestion of a shorter flame cone that surrounds the inner one. A still shorter, outer mantle of flame is formed by burning the primary mix of gas and air passing through the sunburst. When installed in an appliance, an outer cone of burning gas and secondary air surrounds the mantle and extends beyond the inner and outer cones of flame formed at the insert face.

The notch formation of the sunburst consisting of restricted throat areas and downstream expansion areas reduces the velocity of gas flow compared to the velocity of gas flow through the openings of the inner two zones. It has been found that the low velocity flame mantle formed by the sunburst is effective to hold the flame on the face of the insert and reduce the occurrence of liftoff.

The overall configuration of the burner insert therefore improves flame stability. The insert balances three velocities around the burner head in three different zones. This balancing allows the nozzle to achieve desired flame characteristics while not reducing the overall velocity of the gas/air mixture to a point resulting in flashback or increasing the velocity of the mixture to a point resulting in lift-off.

Another feature of the present invention is a burner construction which achieves improved, uniform and consistent cross ignition, i.e. cross ignition of burner nozzles arranged side-by-side. According to the preferred embodiment, the plenum chambers at the sides of each nozzle have restricted outlet slots along the leading and side edges. The restricted slots forming the outlets from the plenums produce back pressure within the plenums which results in continuity of flame from the insert to edges of the plenums. This continuity of flame assures uniform and consistent cross-ignition of the plenums of adjacent nozzles.

Other objects and advantages and a fuller understanding of the invention will be had from the following detailed description of the preferred embodiments and the accompanying drawings.

DESCRIPTION OF PREFERRED EMBODIMENTS

Figure 1:
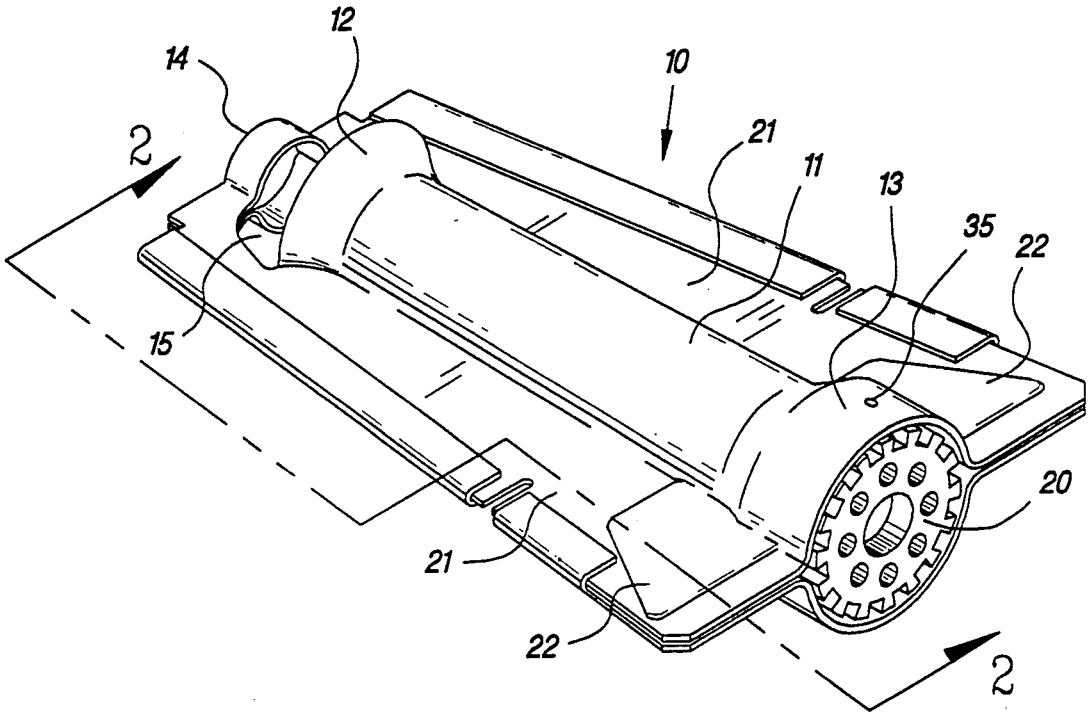
FIG. 1 is a prospective view of an inshot gas burner nozzle made in accordance with the present invention.

Referring now to the drawings, and to FIG. 1 in particular, an inshot burner nozzle embodying the present invention is generally designated by reference numeral 10. The nozzle comprises a venturi tube 11 having a flared inlet end 12 referred to as a bell and an enlarged outlet end or burner head 13. A mounting collar 14 is spaced from the inlet 12 by gap 15 and engages the primary gas supply nipple (not shown). A circular flame retention insert 20 is supported within the burner head 13. Diametrically opposed flanges 21 flank the venturi 11. The flanges 21 define plenum chambers 22 which are in fluid communication with the venturi 11.

Natural gas or propane is injected into the venturi 11 through the bell 12. As the gas enters the bell, it entrains air from the gap 15 through the bell 12 and into the venturi 11. The gas and air mix as they travel through the venturi 11 towards the burner head 13 to form a primary gas/air mixture.

Once the primary gas/air mixture reaches the burner head 13, it encounters the flame retention insert 20 which is supported within the burner head 13. The gas/air mixture passes through various openings of the insert 20 and is burned.

The flame retention insert 20 is preferably made from any suitable material such as powdered or sintered metal, ceramic, etc. and includes an outer face 23 and an inner face 24. The inner face 24 is contained totally within the burner head 13 while the burner face 23 is exposed and is generally flush with the edges 25 of the burner nozzle 10.

The outlets of the insert 20 are arranged in three concentric zones. A primary opening 30 is located in the center of the insert 20. A primary flame forming an inner cone is produced by the burning of the portion of gas/air mixture which exits the primary opening 30.

The primary opening 30 is surrounded by a plurality of circularly arranged, smaller diameter, secondary openings 31. Secondary flames forming a shorter flame cone surrounding the inner cone are produced by the burning of the gas/air mixture which exits the secondary openings 31. The secondary flames are shorter than the primary flame and generally blend in quickly with the primary flame.

The periphery of the insert 20 contains a plurality of edge openings or notches 32. The bottom of each notch 32 is stepped to form a throat 33. Downstream from each throat 33, each notch 32 is deeper, thus 1 forming an expansion region 34.

Tertiary flames are produced by the burning of the portion of gas/air mixture which exits the notches 32. The tertiary flames are very short and burn close to the burner face 23 forming an outer mantle of flame hhich quickly blends in with the secondary flames. The tertiary flames keep the gas/air mixture burning close to the burner face thereby preventing lift-off.

The flame retention insert 20 is held in place within the burner head 13 by two dimples 35 (one is shown in FIG. 1). The dimples 35 are located on opposite sides of the burner head and interact with a corresponding bottom of a notch 32.

The burner nozzle 10 is made by stamping two virtually identical halves 38, 39 out of aluminized steel. The second half 39 has lips 40 at its outer edges which are folded over outer edges of the first half 38 to form the nozzle 10. The nozzle therefore has two diametrically opposed, double walled flanges 21 which define the plenum chambers 22.

Since a burner nozzle is typically used in side-by-side series with other nozzles, it is necessary to cross-ignite adjacent nozzles. The plenums 22 serve this purpose.

The plenums 22 open into the venturi 11 and the burner head 13 adjacent the flame retention insert 20. A portion of the gas/air mixture therefore passes into the plenums 22.

Figure 2:
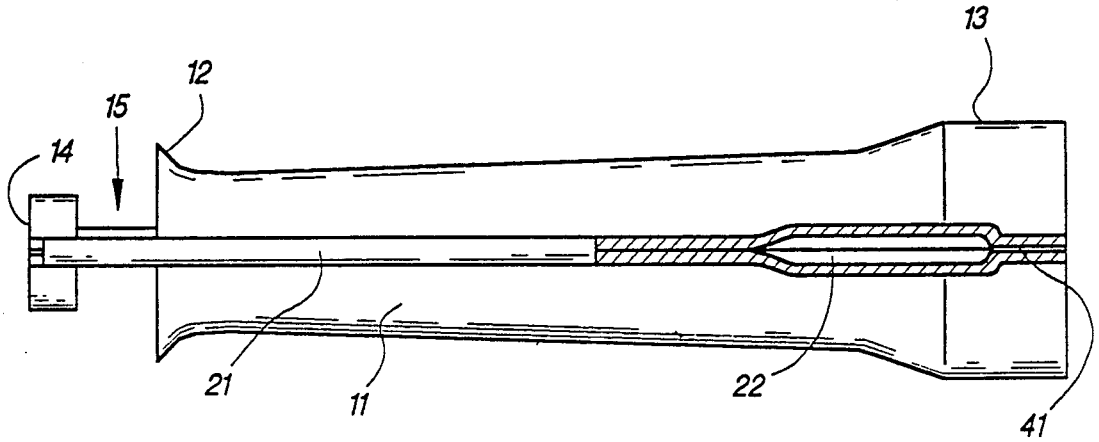
FIG. 2 is a side elevation view shown partially in section as indicated by the line 2—2 of FIG. 1.
Figure 3:
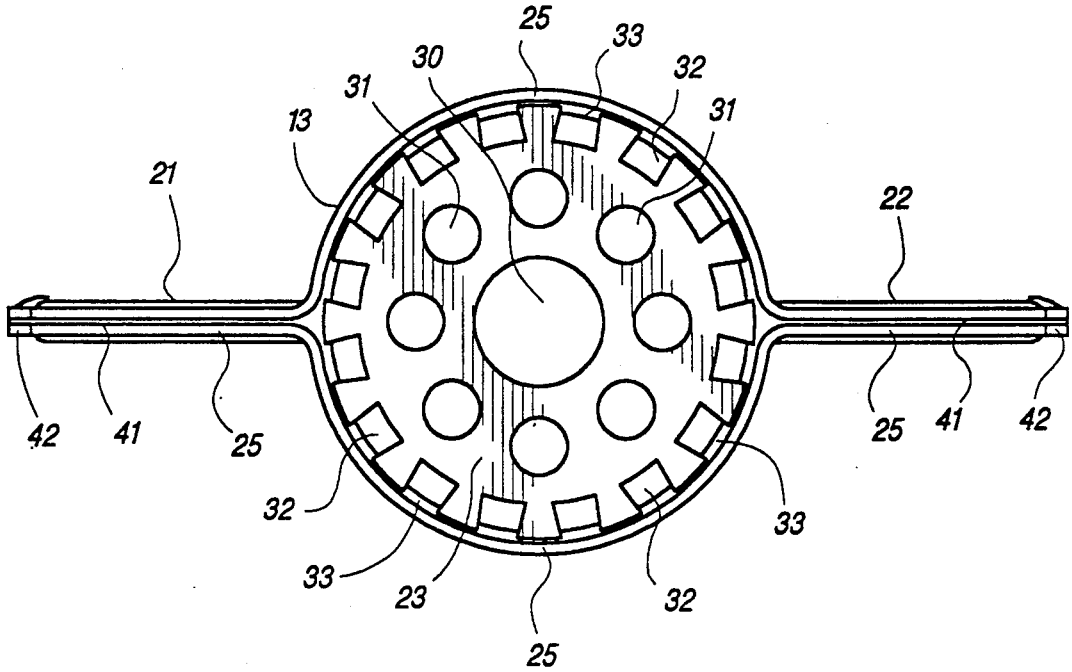
FIG. 3 is an end elevation view.
Figure 4:
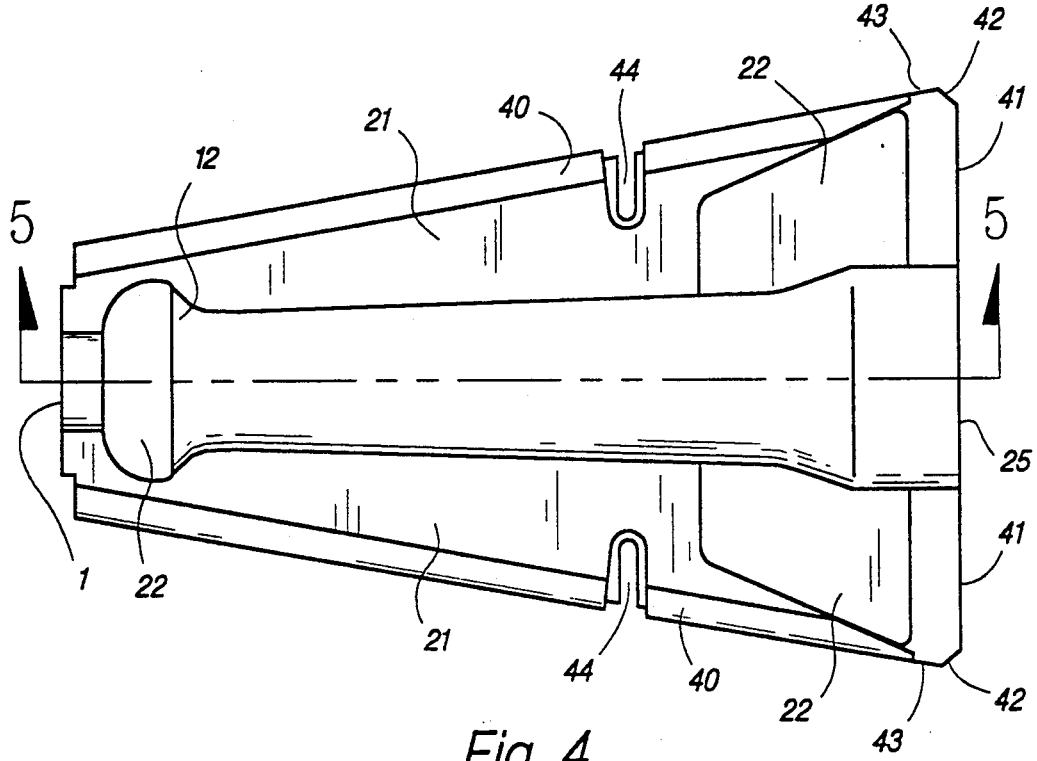
FIG. 4 is a side elevation view.
Figure 5:
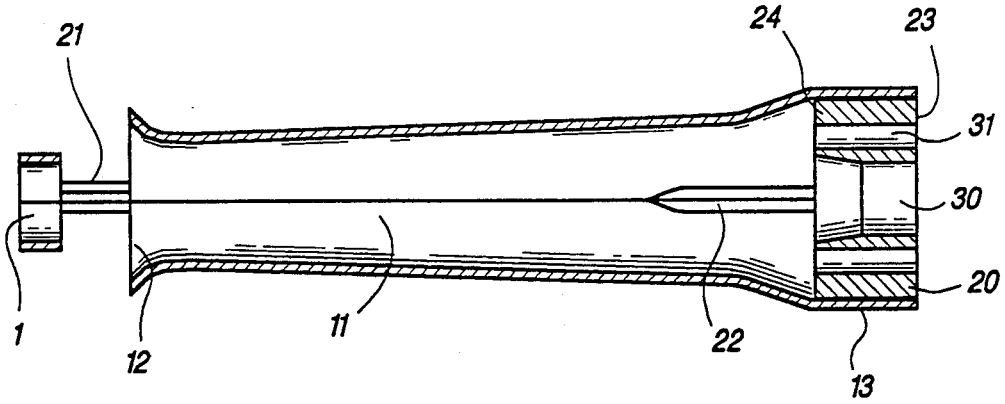
FIG. 5 is a section view taken along the line 5—5 of FIG. 4.
Figure 6:
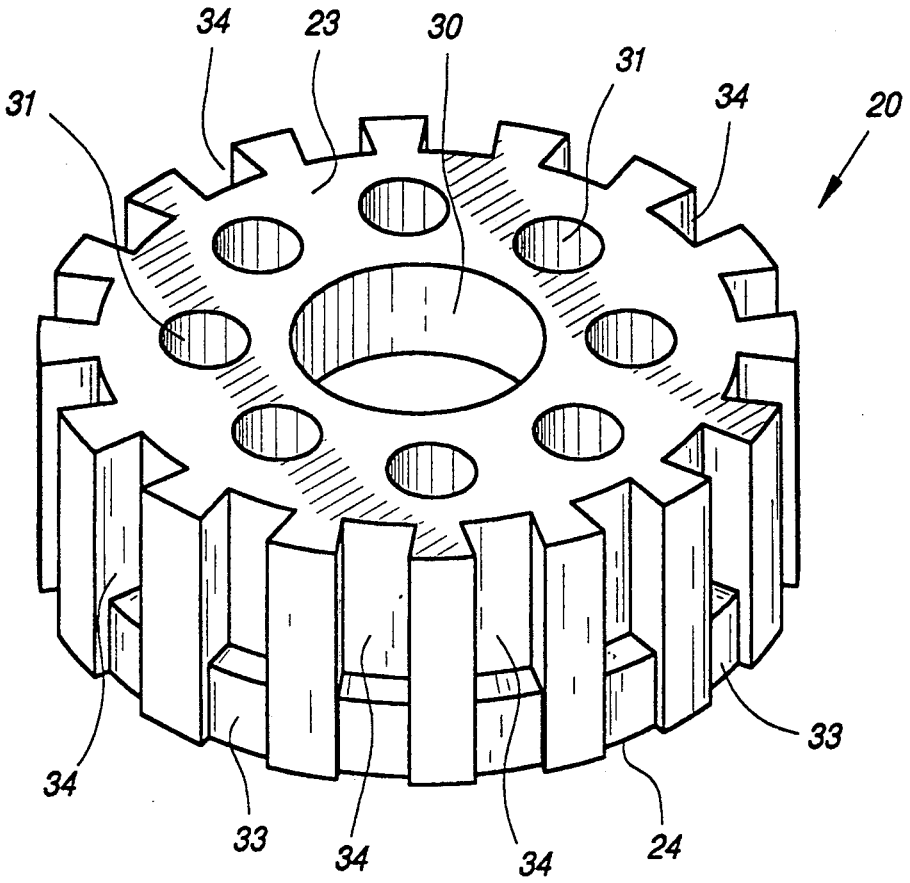
FIG. 6 is a perspective view of a burner insert used in the present invention; and, FIG. 7 is a perspective view of an alternative embodiment of the present invention showing three burner nozzles joined by a continuous channel.

The plenums 22 have slots extending laterally from the burner head 13 along their leading edges to form outlets 41. As best shown in FIGS. 1 and 2, the height of the outlets 41 is less than the transverse cross sectional depth of the plenums 22 such that the outlets 41 are restricted. The outlets 41 are sized to create a back pressure within the plenums 22.

The restricted outlets 41 restrict the flow of the gas/air mixture creating the desired back pressure within the plenums 22 and thereby assure continuity of flame along the plenum outlets 41.

The outlets 41 extend to tapered edges defining cross-igniter locations 42. The cross-igniter locations 42 are connected to side edges 43. The cross-igniter locations have a substantially 450 taper. The taper of the cross-igniter locations 42 improves flame carry-over and shortens the flame produced.

The flanges 21 have mounting slots 44. The slots 44 allow the burner nozzle to be mounted within an appliance (not shown) or multiple burner nozzles to be mounted together within the appliance. The nozzles are typically mounted with a 0.020 inch spacing between them.

When the burner nozzles are installed, they are placed in a housing (not shown). Secondary air flows within the housing and around the nozzle. The secondary air is entrained in the burning primary gas/air mixture around the outside of the insert 20 to complete combustion.

Figure 7:
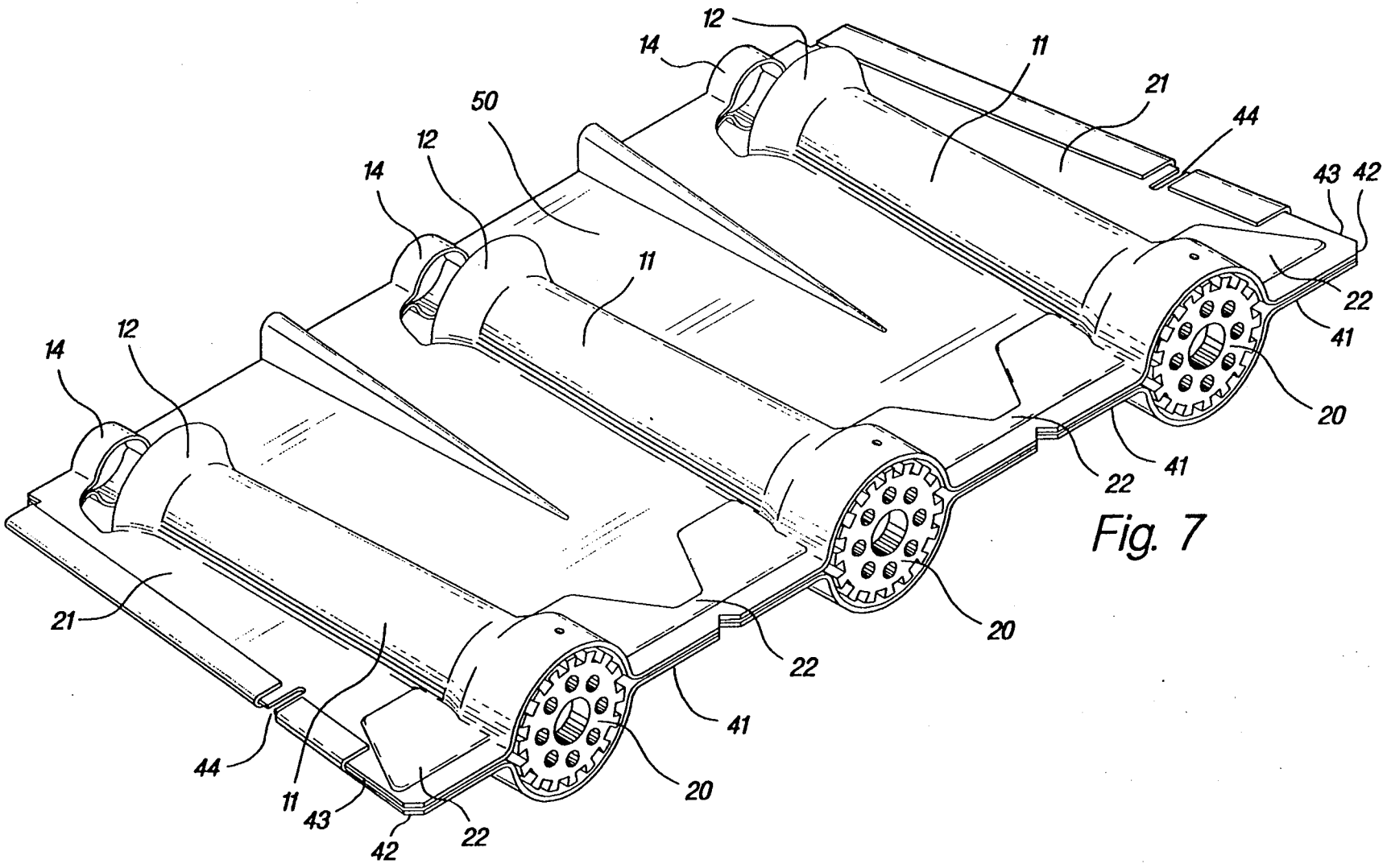

An alternative embodiment is illustrated in FIG. 7. In this embodiment multiple burner nozzles are joined through a continuous channel 50. FIG. 7 illustrates a three burner nozzle embodiment, but the multiple nozzle embodiment can have any desired number of burner nozzles.

The channel 50 creates continuous flanges 21 and plenums 22 among the nozzles. This embodiment allows for improved cross ignition among the nozzles at gas input rates even lower than that of a single burner nozzle.

The multiple burner nozzle embodiment can be used in series with other single burner nozzles or other multiple burner nozzles. The multiple burner nozzle is identical to the single burner nozzle except for its continuous channel 50.

The preferred embodiments of the invention have been illustrated and described in detail. However, the present invention is not to be considered limited to the precise construction disclosed. Various adaptations, modifications and uses of the invention may occur to those skilled in the art to which the invention relates and the intention is to cover hereby all such adaptations, modifications and uses which fall within the spirit or scope of the appended claims.

I claim:

1. A circular burner insert for placement at an outlet end of a burner nozzle comprising:

a. a central opening providing for the emission of gas/air mixture from said tube and the formation of a flame cone projecting from an outer face of said insert;

b. a series of notch openings arranged around the periphery of said insert, said series coaxial with and forming a circle around said central opening, said series of openings having stepped depths with the shallower depths opening on an inner face of said insert to define throat regions and the deeper depths opening on the outer face of said insert to define down stream expansion regions, whereby the gas/air mixture emitted from said series of openings has a lower velocity than that of the mixture emitted through said central opening and forms a flame mantle; and c. a zone of secondary openings between said central opening and said series of openings forming a secondary flame cone between said primary cone and said mantle.

2. A burner nozzle for use in burning a gas/air mixture comprising:

a. a tubular venturi for mixing gas and air, said venturi including:

i. a bell at an inlet end for receiving gas, said gas entraining air through said bell and into said venturi; and ii. a burner head at an enlarged outlet end;

b. a circular burner insert for creating a desired flame pattern and supported within said burner head including:

i. an outer face and an inner face;

ii. a primary opening located at the center of said insert;

iii. a plurality of secondary openings arranged coaxially with and forming a circle around said primary opening; and iv. a plurality of edge openings arranged around the periphery of said insert, said edge openings having restricted inlets at said inner face of said insert; and c. flange means located adjacent and extending laterally from opposite sides of said venturi and defining plenum means in fluid communication with said venturi;

d. said flange means defining a restricted outlet for said plenum means for cross-ignition of an adjacent burner nozzle.

3. The burner nozzle of claim 2 wherein said outlet for said plenum means has a substantially forty-five degree taper at an outermost edge of said flange.

4. A series of burner nozzles for burning a gas/air mixture, said series connected by a continuous channel, each nozzle comprising:

a. a tubular venturi for mixing gas and air, said venturi including:

i. a bell at an inlet end for receiving gas, said gas entraining air through said bell and into said venturi; and ii. a burner head at an enlarged outlet end;

b. a circular burner insert for creating a desired flame pattern and supported within said burner head including:

i. an outer face and an inner face;

ii. a primary opening located at the center of said insert;

iii. a plurality of secondary openings arranged coaxially with and forming a circle around said primary opening; and iv. a plurality of edge openings arranged around the periphery of said insert, said edge openings having restricted inlets at said inner face of said insert; and c. flange means defined by said channel and located adjacent and extending laterally from opposite sides of said venturi, said flange means defining plenum means in fluid communication with said venturi;

d. said flange means defining a restricted outlet for said plenum means for cross-ignition of an adjacent burner nozzle.

5. The series of burner nozzles of claim 4 wherein at least one outermost burner nozzle of said series has a substantially forty-five degree taper at an outermost edge of said outlet for said plenum means.

6. An inshot burner nozzle comprising:

a. a venturi tube having an inlet for receiving primary gas and primary air and an enlarged outlet end; and, b. a burner insert supported within said enlarged outlet end for creating a desired flame pattern, said burner insert including:

i. a central opening providing for the emission of gas/air mixture from said tube and the formation of a flame cone projecting from an outer face of said insert;

ii. a series of openings formed by notches in the perimeter of said insert arranged coaxially with and forming a circle around said central opening, said series of openings having throat regions and down stream expansion regions comprising stepped depths with the shallower depths opening on an inner face of said insert and the deeper depths opening on the outer face of said insert whereby the gas/air mixture emitted from said series of openings has a lower velocity than that of the mixture emitted through said central opening and forms a flame mantle.

7. A burner nozzle as claimed in claim 6 wherein said insert has a zone of secondary openings between said central opening and said series of openings.

8. An inshot burner nozzle comprising:

a. a venturi tube having an inlet for receiving primary gas and primary air and an enlarged outlet end;

b. a burner insert mounted in said outlet end, said insert including:

i. a central opening providing for the emissions of gas/air mixture from said tube and the formation of a flame cone projecting from an outer face of said insert; and ii. a series of openings arranged coaxially with and forming a circle around said central opening, said series of openings being formed by notches in the perimeter of said insert and having throat regions and down stream expansion regions, said notches having stepped depths with the shallower depths opening on an inner face of said insert and the deeper depths opening on said outer face of said insert, whereby the gas/air mixture emitted from said series of openings has a lower velocity than that of the mixture emitted through said central opening and forms a flame mantle; and c. plenum chambers for cross-igniting adjacent burner nozzles and extending laterally from opposite sides of said tube and communicating with its interior near said insert, said plenum chambers having outlet openings which are smaller than the transverse cross-sectional areas of said plenum chambers, whereby back pressure is created in said plenum chambers, said outlet openings having a substantially forty-five degree taper at an outermost edge.

9. A burner nozzle as claimed in claim 9 wherein said insert has a zone of secondary openings between said central opening and said series of openings.

* * * * *